US007622520B2

(12) United States Patent
Cordova et al.

(10) Patent No.: US 7,622,520 B2
(45) Date of Patent: Nov. 24, 2009

(54) LIGHT REFLECTING POLYMERIC ARTICLES CONTAINING BENZOXAZOLYL-NAPTHALENE OPTICAL BRIGHTENERS

(75) Inventors: Abimael Cordova, Whittier, CA (US); Jason Kroskrity, Los Angeles, CA (US)

(73) Assignee: Mattel, Inc, El Segundo, CA (US)

( * ) Notice: Subject to any disclaimer, the term of this patent is extended or adjusted under 35 U.S.C. 154(b) by 39 days.

(21) Appl. No.: 11/500,829

(22) Filed: Aug. 8, 2006

(65) Prior Publication Data

US 2006/0270311 A1 Nov. 30, 2006

Related U.S. Application Data

(62) Division of application No. 11/125,284, filed on May 9, 2005, now Pat. No. 7,108,913.

(51) Int. Cl.
*C07D 209/48* (2006.01)

(52) U.S. Cl. ..... 524/94; 524/92; 524/567

(58) Field of Classification Search ..... 524/94, 524/92, 567
See application file for complete search history.

(56) References Cited

U.S. PATENT DOCUMENTS 2,901,446 A * 8/1959 Hawkins ..... 521/95
3,260,715 A * 7/1966 Saunders ..... 548/219
3,993,659 A * 11/1976 Meyer ..... 548/220
4,058,408 A * 11/1977 Meyer ..... 106/170.11
4,110,246 A * 8/1978 Frischkorn et al. ..... 252/301.28
4,781,647 A 11/1988 Doane, Jr. ..... 446/219
5,053,055 A * 10/1991 Fringeli et al. ..... 8/648
5,714,310 A 2/1998 Noda et al. ..... 430/531
6,818,367 B2 11/2004 Priebe et al. ..... 430/60
7,133,209 B2 * 11/2006 Wursche et al. ..... 359/642

FOREIGN PATENT DOCUMENTS

DE 3313332 A1 * 10/1984

* cited by examiner

*Primary Examiner*—Peter D Mulcahy

(57) ABSTRACT

The present invention provides a highly reflective fluorescent polymer composition comprising a benzoxzolyl naphthalene optical brightener and a polymeric substrate support material formed into three dimensional articles or fibers. The enhanced light reflectivity of the instant compositions occurs over a wavelength range of from about 400 to 700 nanometers. The fiber embodiment comprises a body or support portion made of a flexible and durable thermoplastic material which is at least partially translucent and bis(benzoxazolyl) napthalenes optical brightener molecularly dispersed throughout the polymeric body potion of the fiber. The fibers are fluorescent to a UV source and can be effectively utilized for artificial hair for toy dolls as well as for various other textile applications.

1 Claim, No Drawings

LIGHT REFLECTING POLYMERIC ARTICLES CONTAINING BENZOXAZOLYL-NAPTHALENE OPTICAL BRIGHTENERS

This application is a Divisional Application of prior U.S. application Ser. No. 11/125,284 filed on May 9, 2005 now U.S. Pat. No. 7,108,913.

FIELD OF THE INVENTION

The present invention relates to light reflecting molded or extruded plastics and more specifically to the use of fluorescent optical brightener compositions in formed plastic articles. In one embodiment, thin polymeric fibers impregnated with fluorescent benzoxazolyl optical brightener compositions are prepared and employed as hair in toy dolls.

BACKGROUND OF THE INVENTION

The instant invention relates to light-reflecting molded or extruded articles having a reflectivity high enough to enhance the efficiency of illumination sources, and to methods of making the same. More specifically, the present invention relates to light-reflecting articles made of synthetic organic polymers ("plastics") of certain composition whose structural strength, dimensional stability and other properties make them suitable for use as light-reflecting articles such as toy items for use in conjunction with light sources. The plastic compositions and articles of the invention have a potential total reflectivity of as high as about 93 to 97 percent, which is attained without the necessity of using reflective films, metal coatings, or reflection enhancers other than the compositions disclosed herein. The enhanced light reflectivity of the instant compositions occurs over a wavelength range of from about 400 to 700 nanometers.

The plastic compositions of the present invention have particularly beneficial use in toy articles. It has long been recognized that the play value of certain toy dolls can be significantly increased by imparting phosphorescent or luminescent properties to the hair thereof. Specifically, it has been recognized that by imparting color generating, or other illuminating, properties to the hair of certain toy dolls, the dolls can be effectively incorporated into imaginary concepts and themes wherein they are capable of having imaginary dreams. More specifically, it has been found that by imparting glow-in-the-dark or fluorescent properties to the hair of certain toy dolls, the dolls can be effectively incorporated into a theme wherein they live in an imaginary dream world where toy dolls are capable of having nighttime dreams.

As a result of the recognized benefits of providing relatively thin extruded filament fibers having phosphorescent properties for use in toy doll constructions as well as in other applications, one embodiment of the present invention is directed to a relatively thin, durable, translucent and fluorescent fiber which can be effectively utilized for imitation hair strands as well as for other applications, such as for textile fibers. In this regard, it has been found that doll hair fibers made from presently available flexible and durable clear plastic polymeric materials must generally have substantially uniform cross sectional dimensions which are in the range of between approximately 0.02 in. and 0.004 inches. Further, it has generally been found that fibers of these material types must possess sufficient strengths to enable them to be mechanically rooted in the heads of toy dolls and also to enable them to withstand substantial abuse.

In contemplating the use of optical brighteners or whiteners for use in extruded or molded polymer articles for reflectivity enhancement, such whiteners must also be stable to the temperatures as high as from 310 C to 330 C, which are used in processing the optical brightener into the polymeric material (eg. polyolefin) and in extruding the polymer into fiber. Additionally, the optical brightener must be non-migrating so that it remains in the polymeric material and does not exude or leach as a surface film on the polymeric molded article or extruded fiber. Such exudation may not only give rise to a nonuniform brightness of the polymer compositions and articles, but also such leaching material readily transfers to any other surface contacted with it, making it unsuitable for manual use in a child's toy. For example, when the fiber is used as doll hair, the brightener in the fiber may be transferred to the fiber surface support when the hair is wound manually by a child, adversely affecting the quality and performance of the toy.

The instant invention provides light reflecting polymeric compositions that have naphthalene-benzoxazole fluorescent brighteners or whiteners dispersed therein. These naphthalene-benzoxazole whiteners are compounds which absorb ultraviolet light and emit fluorescent light and are exemplified by bis(alkyl substituted benzoxazolyl)naphthalene compounds. In one embodiment herein, polymeric fibers are impregnated with a benzoxazolyl naphthalene optical brightening agent which can be utilized for a variety of applications including use as imitation hair fibers for toy dolls.

It has been found that generally available optical brighteners do not exhibit the combination of absorption/emission characteristics and brightening power, heat stability, and resistance to brightener exudation to the levels desired for light reflecting molded polymer articles, particularly those used in toys products. Accordingly, there remains a need for molded or fibrous polymeric articles containing optical brighteners or whiteners to enhance light reflection, the polymeric article having improved resistance to brightener exudation and wherein the optical brightener (whitener) exhibits excellent absorption/emission characteristics, brightening power and heat stability, as these characteristics relate to toy use.

SUMMARY OF INVENTION

In accordance with the present invention, there is provided novel light reflecting and fluorescent molded or extruded articles comprising a thermoplastic or thermosetting polymeric matrix having dispersed particles of an optical brightening agent therein, these articles having a reflectivity high enough to enhance the efficiency of fluorescent illumination sources. The molded article can be in the form of a solid piece formed from opaque, translucent, or partially translucent polymer material. Alternatively, the instant light reflective, fluorescent polymeric composition can be extruded into fluorescent sheets, fibers or filaments (fine fibers), the fluorescent fibers being one preferred embodiment of the polymeric articles of the present invention. The fluorescent fibers of the instant invention are preferably at least partially translucent and made in an extrusion process, and the fibers comprise a durable polymeric material which is at least partially translucent and an optical brightening agent comprised of a benzoxazolyl naphthalene. The fluorescent fiber of the present invention has a cross sectional dimension of less than approximately 0.02 in. and preferably in the range of between 0.002 in. and 0.004 in. and the fiber is preferably made of a material selected from polyolefin, polyamide, polyesters, polyacrylonitriles and polyvinyl chloride polymers.

The purpose of the benzoxazolyl naphthalene optical brightener in the polymer composition of the instant invention is to make any clear areas of a fiber or molded structure appear even brighter and to fluoresce upon exposure to a UV source. The optical brightener fluoresces upon irradiation with UV (ultraviolet) light, emitting visible light, usually bluish in hue, thereby enhancing the brightness of the fiber substrate. Optical brighteners for use in the instant polymer materials must absorb UV light, especially in the region from 300 to 420 nm (nanometers), and emit this energy as visible light in the wavelength range of from about 400 to 470 nm to enhance the brightness of the polymeric article or fiber. The enhanced light reflectivity of the instant compositions occurs over a wavelength range of from about 400 to 700 nanometers which renders a fluorescent source efficient. The optical brightener must also be stable to temperatures as high as from 310 C to 330 C, which are used in processing the optical brightener into the polymeric material (eg. polyolefin) and in extruding the polymer into fiber.

The present invention relates to a light reflecting polymer article, wherein said article comprises a clear or opaque polymeric material base and an optical brightener selected from the benzoxazolyl derivative compounds of naphthalene, said compounds having the general formula:

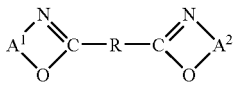

wherein the radical R is a bivalent naphthalene radical and each of the radicals $A^1$ and $A^2$ is an o-phenylene radical.

More precisely, in a preferred embodiment the invention is directed to a fiber substrate support element comprised of a clear polymeric base material and at an optical brightener comprising 1,4-di(benzoxazoly1-2')naphthalene and bis (alkyl substituted benzoxazolyl)naphthalene derivatives. The polymeric material used in the fiber embodiment of the instant invention is preferably clear to the extent of being at least partially translucent. The compounds of the invention comprise the class of naphthalene derivatives having benzoxazolyl subsituents in the 1,4 positions of the naphthalene radicals. The compounds of this class have unexpectedly superior fluorescent properties when used as whitening or brightening agents and, in addition, have certain other properties such as heat stability (for melt processing), light stability, stability toward bleaches and other oxidizing environments, stability in fiber processing treatments, etc., which make them especially useful as whitening or brightening agents for textile materials, particularly synthetic linear extruded fiber such as polyvinyl chloride.

The methods employed for preparation of the instant invention are generally well known and comprise the steps of mixing the benzoxazolyl naphthalene brightener particles with an unhardened polymeric material, heating the mixture to form a polymer melt, and alternatively (i) extruding the resultant mixture to form fibers having sectional dimensions which preferably are less than approximately 0.020 in. but greater than 0.002 in. or (ii) molding the melt to form a three dimensional reflective article. In accordance with these methods, the brightener particles are preferably first premixed with a coating agent, which is suitable for coating the brightener particles. In this regard, it has been found that the use of these agents of this type effectively enhances the distribution of the benzoxzolyl naphthalene brightener particles in finished fibers or molded articles so that these polymeric articles have substantially uniformly fluorescent properties and so that they are not significantly weakened by areas of high concentrations of the brightener particles therein.

The simplicity of the instant composition and the various applications employing its use provide a readily usable process employing available equipment and preliminary mixing cycle instructions. The instant process and outlined procedures allows a manufacturer to use existing mixing equipment such as injection molding, extrusion, blow molding, roto-cast and compression molding tools. Flexibility is an option in that the manufacturing process may be change based on the ready availability of production equipment. In addition, the instant naphthalene optical brightener or whitener can be use in many popular plastics such as polyvinylchloride (PVC), polyethylene (PE), polypropylene (PP), polystyrene (PS), ethylene vinyl acetate (EVA), cellulose acetate (CA), polyethylene vinyl acetate (PEVA), styrene butadiene copolymer such as acetyl butadiane styrene (ABS), polyesters, acrylonitrile polymers and copolymers, and polyamides. In a preferred specific embodiment, 1,4-Bis(benzoxazolyl-2-yl) naphthalene is a fluorescent whitening agent that can be readily used within the purview of the instant invention for whitening and brightening plastic injection molded fiber materials employed in doll hair.

In sum, the present invention is directed to a molded or extruded fluorescent polymeric article and, more particularly, to a fiber having a cross-section of less than 0.02 inches comprised of a flexible polymeric material which is at least partially translucent and a benzoxazolyl naphthalene optical brightener, present in an amount of from 0.001 to 30 wt % of the polymeric base material. While it is generally found that the fluorescent fibers (or filaments) of the instant invention can be utilized for a variety of different applications, such as for manufacturing fluorescent fabrics and the like, the instant fibers have been found to be particularly effective for use as artificial hair in a toy doll. A doll item will have the instant fluorescent fibers permanently rooted in, or otherwise stranded on, the doll's head to provide a crop of artificial hair fibers thereon and the hair is illuminated when exposed to a UV source to provide a child with imaginary themes.

The invention can best be understood with reference to the accompanying detailed description of the preferred embodiments.

DETAILED DESCRIPTION OF INVENTION

The present invention advantageously demonstrates the incorporation of a benzoxazolyl naphthalene optical brightener in a plastic support material and the molding or extruding of the resulting composition into a light reflecting fluorescent polymeric article or fiber. The support comprises a base polymer material such as polyolefin and at least one benzoxazolyl naphthalene optical brightener. As indicated, the invention is described particularly with regard to preferred embodiments as an optically brightened fiber for hair use on a toy doll. However, the invention may be useful in other applications requiring use of an optically brightened polymer. The benzoxazolyl naphthalene optical brighteners used in the practice of the present invention exhibit absorption/emission characteristics as good as or better than other brighteners presently utilized in molded, fiber and textile articles. Further, this polymer/brightener mixture provides the desired brightening and fluorescent power at relatively low brightener concentrations, which is commercially attractive from a cost saving and toy safety standpoint. The disclosed benzoxazolyl naphthalene optical brighteners have been found to be stable to temperatures as high as 330 C. thereby rendering them useable in melt processing of fibers as contemplated herein. Moreover, the unexpected advantageous resistance of the instant doll hair fiber element to brightener exudation at the surface of the polymer support is advantageously exploited during extensive playtime of children with a doll having the present optically brightened hair fibers.

The bis(benzoxazolyl)napthalenes optical brighteners useful herein comprise all the above-noted features of benzoxazolyl naphthalene compounds, which are known optical brighteners. These brightener compounds are also known for optical brightening use in synthetic polymer film or sheet articles but their compositional use herein as well as their use in molded toy articles and fibers in a toy doll element have not been disclosed nor suggested heretofore. To obtain a fluorescent fiber as described herein, the polymer and benzoxazolyl naphthalene optical brightener may be mixed according to conventional means or the mixture may be obtained as the product of another synthesis available to skilled technicians. The optical brightener mixture may be directly incorporated into the polymer by conventional mechanical mixing methods. Preferred are methods whereby the brightener is uniformly dispersed within a melted polymer and a fiber extrusion is carried out to draw a filament (thin fiber). Melt mixing methods include a melt extrusion process, a kneader extruder, a roll mill, a high shear mixer, or a twin-screw compounder.

The optical brightener compounds and prepared articles utilized in this invention are comprised of naphthalene derivatives having benzoxazolyl substituents in the 1,4' positions of the naphthalene radicals. As indicated above, the compounds of this class have unexpectedly superior fluorescent properties when used as whitening or brightening agents and, in addition, have certain other properties, including but not limited to heat stability, light stability, stability toward bleaches and oxidants, and stability in textile or filament processing treatments, which make them especially useful as whitening or brightening agents for use in thermoplastic polymers in the form of coatings or fibers, preferably in the extrusion coating, casting, drawing, or orienting of plastic or polymeric films or fibers. More specifically, the optical brighteners of the subject invention are fluorescent compounds of benzoxazolyl naphthalene comprising 1,4-di(benzoxazolyl-2')naphthalene and bis(alkyl substituted benzoxazolyl) naphthalene derivatives. The bis(alkyl substituted benzoxazolyl) naphthalene derivatives include the following benzoxazolyl naphthalene formulas and structures:

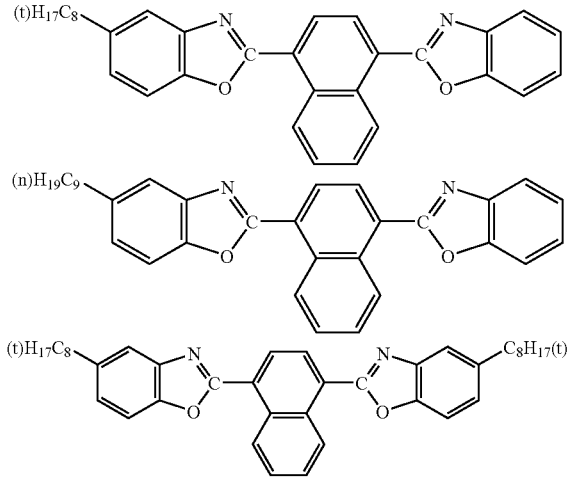

-continued

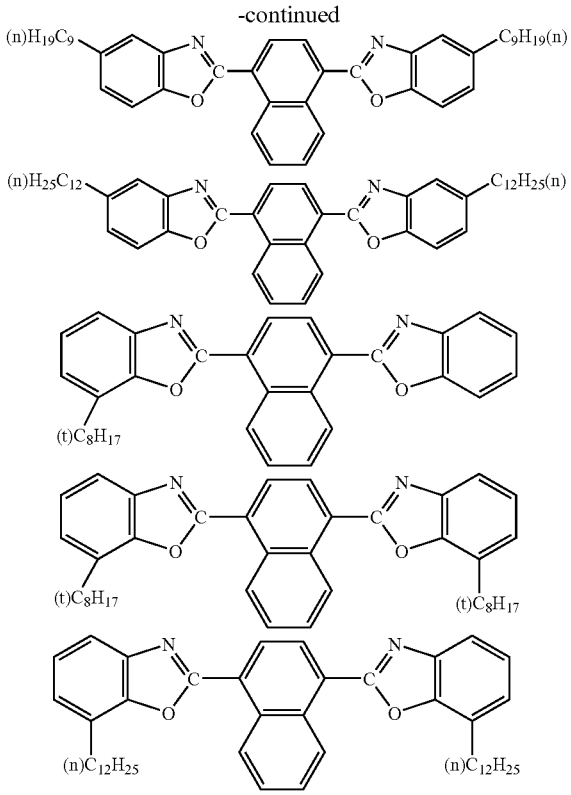

Another aspect of the present invention provides for the inclusion of an optical brightener selected from fluorescent materials which absorb radiant energy in the ultraviolet region of the electromagnetic spectrum (wavelengths 300 nanometers to 400 nanometers) and emit this energy as visible light in the blue region of the spectrum (wavelengths from 400 nanometers to 470 nanometers). The instant 1,4-di(benzoxazolyl-2yl)naphthalene optical brighteners within the scope of the instant invention are compounds which absorb ultraviolet light and have a peak ultraviolet absorbtion in the range of 300 to 400 nanometers of the electromagnetic spectrum. In actual use herein, the optically brightened and clear (translucent) plastic fibers of the instant invention fluoresce visible light at a wavelength of maximum emission of 420 to 450 nanometers and therefore appear blue-violet when viewed in daylight or ultraviolet light. Examples of commercially available optical brighteners containing 1,4-di(benzoxazolyl-2yl)naphthalene include Hostalux KCB, and Hostalux KSB from Clariant of Muttenz, Switzerland and Hoechst T 1258 from Hoechst of Germany.

The exact concentration of the instant fluorescent 1,4-di(benzoxazolyl-2yl)naphthalene optical brighteners used as fluorescent whitening agent for the instant polymeric fibers may be varied widely. Particularly good results are obtained at concentrations of about 0.002 to about 5% by weight of the novel fluorescent 1,4-di(benzoxazolyl-2yl)naphthalene compounds based on the weight of the clear polymer fiber material treated (eg. polyester). The instant 1,4-di(benzoxazolyl-2yl)naphthalene optical brighteners can be introduced into the polymeric fiber generating by conventional disperse dyeing techniques or by other known methods. These preferred 1,4-di(benzoxazolyl-2yl)naphthalene optical brighteners impart little or no visible color to a clear fiber generating plastic (eg. polyester) when present in an amount effective for the instant whitening or brightening purposes and are free of substituents which would cause the fluorescent compound to impart a visible color to the polymer base fiber material when used in the amount defined herein.

The fluorescent 1,4-di(benzoxazolyl-2yl)naphthalene compounds of the present invention have satisfactory stability. Therefore when these optical brighteners are incorporated in a polymer fiber substrate in an amount effective for whitening, brightening or fluorescing purposes, the benzoxazolyl naphthalene/polymer fiber elements produce a composition of exceptional whiteness or brightness and fluorescent responsiveness to a UV source that is highly resistant to discoloration or loss of whiteness upon exposure to light, air, washing, and oxidizing agents. In addition, because of their excellent heat stability, these 1,4-di(benzoxazolyl-2yl)naphthalene compounds can be readily incorporated into a polymer hot-melt (eg. polyester) from which a fiber is spun. And again the resulting fiber composition exhibits fluorescence and exceptional whiteness or brightness and is highly resistant to change in the open environment as well as in textile processing treatments.

In accordance with the present invention the polymer matrix may be any substantially clear, white or otherwise opaque thermoplastic or thermosetting polymer, such as those chosen from the group consisting of polyacrylonitrile, polyesters, epoxies, polyurethanes, acrylonitrile-butadiene-styrene terpolymer, poly(methylpentene), polypropylene, polystyrene, polycarbonate, polymethacrylate, polyacrylate, poly(vinyl chloride), chlorinated polyethylene, acrylonitrile-butadiene-styrene (ABS) and substituted derivatives, copolymers, blends and alloys of any of the foregoing. In a related preferred aspect of the invention, the polymer matrix comprises a blend of the acrylonitrile-butadiene-styrene copolymer with polyvinyl chloride polymer, or a blend of the acrylonitrile-butadiene-styrene terpolymer with a polycarbonate polymer. For example, the polymer matrix may comprise from about 10 to 50 weight percent of the acrylonitrile-butadiene-styrene (ABS) terpolymer and from about 40 to 90 weight percent of the polycarbonate polymer.

Various additional optional additives may also be incorporated in the reflective fluorescent thermoplastic or thermosetting compositions of the present invention depending on the requirements of the polymers chosen and their use environment. Examples of these include antioxidants, photostabilizers, free radical scavengers, and UV absorbers. Antioxidants include such compounds as phenols and particularly hindered phenols including Irganox 1010 from Ciba Specialty Chemicals of Basel, Switzerland, sulfides, organoboron compounds, organophosphorous compounds, N,N'-hexamethylenebis (3,5-di-tert-butyl-4-hydroxyhydro-cinnamamide) available from Ciba Specialty Chemicals under the tradename Irganox 1908. A new antioxidant product specifically recommended for use with ABS is Irganox 1141 from Ciba Specialty Chemicals. Photostabilizers and more particularly hindered amine light stabilizers include but are not limited to poly[6-morpholino-s-triazine-2,4-diyl)[2,2,6,6-tetramethyl-4-piperidyl)imi no]-hexamethylene] available from Cytec Industries of Kalamazoo, Mich. under the tradename Cyasorb UV3346, and Hostavin N-30 from Clariant of Muttenz, Switzerland. Suitable free radical scavengers include oxygen, hindered amine light stabilizers, hindered phenols, 2,2,6,6-tetramethy-1-piperidinyloxy free radical (TEMPO), and the like. UV absorbers include benzotriazole, hydroxybenzophenone, and the like. These additives may be included in quantities, based upon the total weight of the composition, from about 0% to about 6%, and preferably from about 0.1% to about 1%. Preferably all components of the overall composition are in admixture with one another, and most preferably in a substantially uniform admixture.

To recapitulate, the instant invention provides an effective solution to the challenge of providing reflective fluorescent polymeric articles, particularly fibers, which can be utilized for a variety of applications including use as imitation hair fibers for toy dolls. As one embodiment, the instant invention provides a novel UV absorbing and emitting fiber construction and an effective method for manufacturing these fluorescent fibers. The fluorescent fibers of the instant invention are preferably made in an extrusion process, and the fiber comprises a body portion made from a durable and hard polymeric material which is at least partially translucent and benzoxazolyl naphthalene molecularly dispersed throughout the polymeric body portion of the fiber. The fiber (body portion) has a cross sectional dimension of less than approximately 0.02 in. and preferably in the range of between 0.002 in. and 0.004 in. and it is preferably made of a material selected from the group consisting of polyamides, polyesters, polyolefins, such as polyethylene (PE) (eg. HD/LDPE) and polypropylene (PP), polystyrene polymers and copolymers, such as styrene-butadiene copolymers (eg. SBS, SIS, SBES), polyacrylonitriles, Saran (vinyl chloride-vinylidene chloride copolymer), and polyvinyl chloride (PVC).

The method for preparing the instant fluorescent polymeric filament articles is directed to the steps of thoroughly mixing the optical brightener particles with an unhardened heated polymeric material and extruding the resultant mixture to form fibers having sectional dimensions which are less than approximately 0.02 in. In the heating, thorough mixing, and extrusion steps of the instant method of preparation, a substantially uniform distribution of the brightener particles molecularly dispersed throughout the polymeric fiber composition is achieved. The polymeric material preferably comprises a material selected from the group consisting of polyamides, polyesters, polyolefins, polyacrylonitriles and polyvinyl chlorides; and the benzoxazolyl naphthalene optical brightener particles preferably comprise between 0.001% and 30% by weight of the polymeric material. After the brightener particles have been mixed with the polymeric material, the resultant mixture is heated to a homogeneous melt and the melt is extruded preferably in a extrusion or dry spinning process to form fibers having sectional dimensions which are less than approximately 0.020 in. and preferably between about 0.002 and 0.004 inches.

The present invention contemplates using an injection molding cycle in the preparation of the instant fluorescent filaments. The steps of such an injection molding process include (1) melting of the translucent plastic resin and the benzoxazolyl naphthalene optical brightener particles; (2) injecting the melted plastic composition into a mold; (3) cooling the mold thereby hardening the plastic; and (4) extruding the cooled plastic through a dye to form the fluorescent filaments of the invention. Temperatures of the various steps of the molding process will vary depending on the particular resin used as the substrate support for the fiber. For example polypropylene melts at temperatures of from 191° C. on through 232° C. and cools at temperatures of from 32° C. through 66° C. Such parameters are readily available in the prior art and current publications, widely known to those skilled in the polymer arts. The injection molding process occurs cyclically with typical cycle times ranging from 10 to 100 seconds and is controlled by the cooling time (currying time) of the thermoplastic of the thermosetting plastic. The plastic resin is in the form of pellets or powder and is fed from a hopper and melted along with the optical brightener of the invention. In a reciprocating screw type injection molding machine, the screw rotates forward and fills the mold with melt, holds the melt under high pressure, and continually adds more melt to compensate for the contraction due to cooling and solidification of the polymer (hold time). The solidified melt composition is continuously extruded through dies to form the instant fluorescent fibers thereby avoiding any injection gate freeze.

While it is believed that one of skill in the art is fully able to practice the invention after reading the foregoing description, the following examples further illustrate some of its features. As these examples are included for purely illustrative purposes, they should not be construed to limit the scope of the invention in any respect.

EXAMPLES

Examples of fluorescent fiber and polymeric article compositions of the present invention are as follows. These examples further illustrate the present invention but, of course, should not be construed as in any way limiting its scope. Quantities are in percent by weight of the total composition. These example compositions demonstrate suitability for use in both fluorescent polymer articles or artificial hair fibers for toy dolls.

Example 1

Light Reflecting Polymeric Compositions A and B are each separately formed by melt mixing, in an extruder, the various components listed in weight percent in Table 1 below:

TABLE 1

| COMPONENT | A | B |
|---|---|---|
| Polymer | | |
| Polypropylene Homopolymer - 12 melt flow | 89.300 | 83.297 |
| Antioxidants | | |
| Pentaerythritol Tetrakis(3-(3,5-di-tert-butyl-4-hydroxyphenyl)propionate) | 0.250 | 0.250 |
| Tris(2,4-ditert-butylphenyl)phosphite | 0.250 | 0.250 |
| Distearyl thiodipropionate | 0.100 | 0.100 |
| Lubricants | | |
| Zinc Stearate | 0.080 | 0.080 |
| Zinc Dibutyl Dithiocarbamate | 0.020 | 0.020 |
| Optical Brightener | | |
| 1,4-di(benzoxazolyl-2yl)naphthalene - | 10.00 | 17.003 |
| Total | 100.000 | 100.000 |

In accordance with processes and techniques well known to those skilled in the art, the compositions are then each drawn into fibers approximately 0.003 inches in diameter via the molten state (melt-attenuated) using a laboratory spinning apparatus using conventional polypropylene processing conditions (375-425.degree. C.). Both fiber Compositions A and B exhibit Light Reflectivity of about 98% (with fluorescent activation) of light over a wavelength range of from about 450 run to about 700 nm.

Example 2

Samples of reflective ABS compositions are prepared by compounding by high-shear mixing a high gloss ABS resin with varying amounts, as shown in Table 1 below, of 1,4-di (benzoxazolyl-2yl)naphthalene which is surface-modified and pulverized to aid dispersion. The ABS polymer was a high-gloss material. The 1,4-di(benzoxazolyl-2yl)naphthalene is sold under the trademark Hostalux KS1 by Clariant of Muttenz, Switzerland.

Plaques of the ABS compositions are molded from the compounded resin with a mold which had respective regions of glossy and matte finishes. Reflectance measurements were made on the the plaque (1.9 mm thick) with a fluorescent source and all exhibited Light Reflectivity exceeding 92% (with fluorescent activation) of from about 450 nm to about 700 nm.

TABLE 2

| | Sample # | | |
|---|---|---|---|
| | 1-1 | 1-2 | 1-3 |
| Hostalux KS1 (wt %) | 6.70% | 10.00% | 12.50% |
| Total Reflectance* (%) | 92.28 | 95.26 | 96.33 |

While it has been generally found that the fluorescent polymers of the subject invention can be utilized for a variety of different applications, such as for manufacturing fluorescent molded polymeric articles, fabrics and the like, they have been found to be particularly effective as fluorescent fibers for use as artificial hair fibers for toy dolls. In this regard, a doll comprises a toy doll of generally conventional construction, including a torso body and a removable head portion, a construction well known in the toy industry. See U.S. Pat. No. 6,776,681 illustrating a doll structure and hereby incorporated by reference in its entirety. The doll head requires hair and includes a plurality of the fibers which are preferably permanently rooted in the removable head to provide artificial hair fibers thereon. In this regard, it has been found that by utilizing the instant fluorescent fibers as synthetic or artificial hair fibers on the doll's head in combination with a UV source, the play value of the doll can be substantially enhanced. Specifically, it has been found that by imparting fluorescent properties to the hair of the doll and intermittently exposing the doll's hair to a UV source, the doll can be used in novel imaginary themes and concepts wherein an imaginary new character is embodied in the doll by the UV exposure. In this regard, it has been found that by imparting fluorescent characteristics to the hair of the doll, the play value of the doll as an imaginary character and as a nighttime companion for small children is substantially enhanced. It has been further found that the fluorescent hair of the doll tends to stimulate the imaginations of children playing therewith and that it therefore substantially increases the child appeal of the doll.

It is seen therefore that the instant invention provides an effective fluorescent fiber construction which can be effectively utilized in a variety of applications. It has been found that by maintaining the amount of the fluorescent brightener within the ranges specified herein, fluorescent properties can be imparted to the plastic fibers without reducing the translucency or tensil strengths thereof to unacceptable levels. It has also been found that the instant fluorescent fibers can be effectively manufactured in accordance with the method of the instant invention and that they have particular application as artificial hair fibers for toy dolls. Hence, it is seen that the instant invention represents a significant advancement in the art which has substantial commercial merit.

All of the references cited herein, including patents, patent applications, and publications, are hereby incorporated in their entireties by reference.

Although the present invention has been particularly described in conjunction with specific preferred embodiments, it is evident that many alternatives, modifications, and variations will be apparent to those skilled in the art. It is therefore contemplated that the appended claims will embrace any such alternatives, modifications, and variations as falling within the true scope and spirit of the present invention.

What is claimed:

1. A composition comprising:

(a) a polyvinyl chloride polymeric substrate support material, and;

(b) the fluorescent optical brightener 1,4-di(benzoxazolyl-2') naphthalene molecularly dispersed throughout the polymeric material in an amount of from 5 to 20% weight percent, the composition demonstrating an enhanced light reflectivity occurring over a wavelength range of from about 400 to 700 nanometers.

* * * * *